United States Patent [19]

Ellena

[11] Patent Number: 4,733,682

[45] Date of Patent: Mar. 29, 1988

[54] TUBULAR CRUTCH CONSTRUCTION

[75] Inventor: Nathan L. Ellena, Woodland Hills, Calif.

[73] Assignee: Guardian Products, Inc., North Hollywood, Calif.

[21] Appl. No.: 942,211

[22] Filed: Dec. 16, 1986

[51] Int. Cl.[4] ..... A61H 3/02

[52] U.S. Cl. ..... 135/69; 135/65; 135/68; 135/75; 403/102; 403/327; 403/322

[58] Field of Search ..... 135/66, 67, 68, 69, 135/70; 33/161, 515

[56] References Cited

U.S. PATENT DOCUMENTS

| | | | |
|---|---|---|---|
| 1,035,760 | 8/1912 | Walton | 135/69 |
| 1,317,386 | 9/1919 | Pearl | 135/69 |
| 3,016,060 | 1/1962 | Beattie | 135/68 |
| 3,858,596 | 1/1975 | Thomas | 135/69 |
| 3,886,962 | 6/1975 | Diamontis | 135/69 |
| 4,386,466 | 6/1983 | Lee | 33/515 |
| 4,509,741 | 4/1985 | Smith | 33/515 |

FOREIGN PATENT DOCUMENTS

| | | | |
|---|---|---|---|
| 722428 | 11/1965 | Canada | 135/69 |

*Primary Examiner*—Robert A. Hafer
*Assistant Examiner*—Charles H. Sam
*Attorney, Agent, or Firm*—Beehler, Pavitt, Siegemund, Jagger, Martella & Dawes

[57] ABSTRACT

A crutch of tubular construction has two crutch bows with straight parallel lower ends, between which is a leg carrier tube held by an upper fastener and lower rivets, and a crutch leg telescoped in the carrier tube. Weak points are avoided by gradually flattening the bows from a cylindrical cross section at the upper fastener through intermediate partially flattened bow portions to fully flattened bow ends at the lower rivets.

7 Claims, 9 Drawing Figures

FIG. 1
PRIOR ART
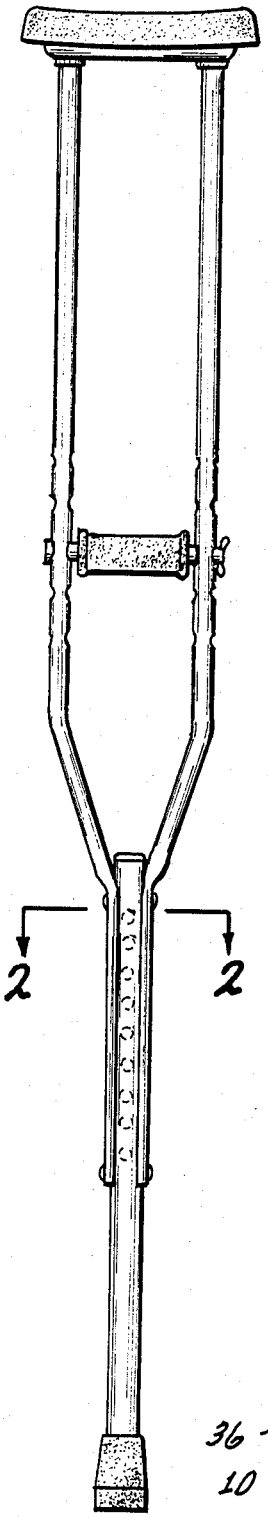
FIG. 2
PRIOR ART
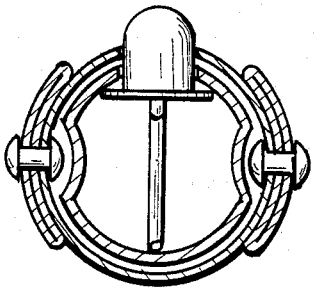
FIG. 3
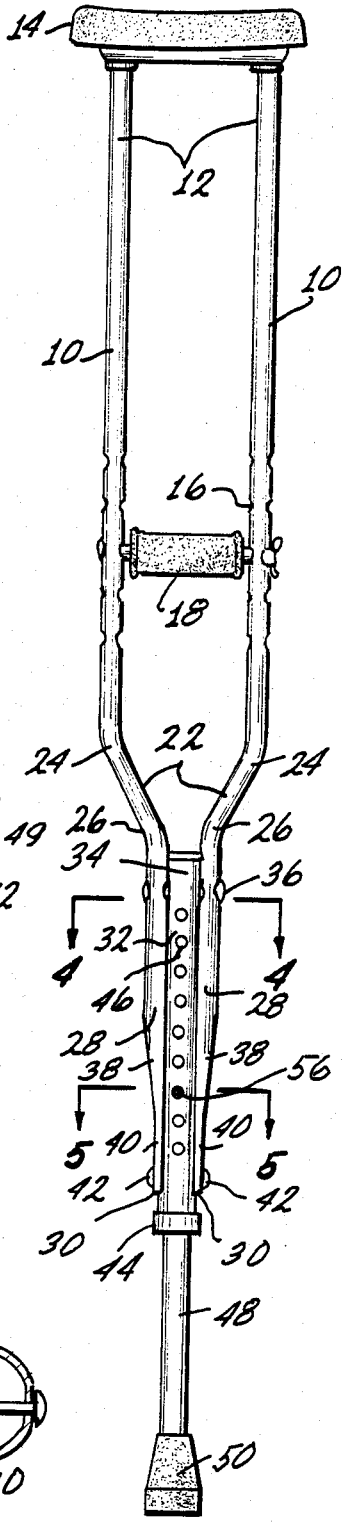
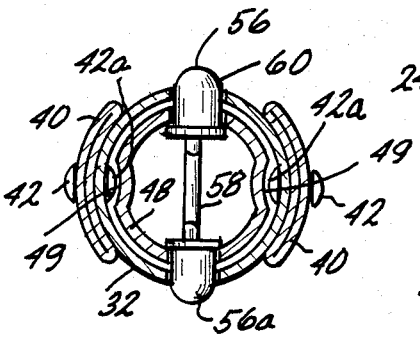
FIG. 5
FIG. 4
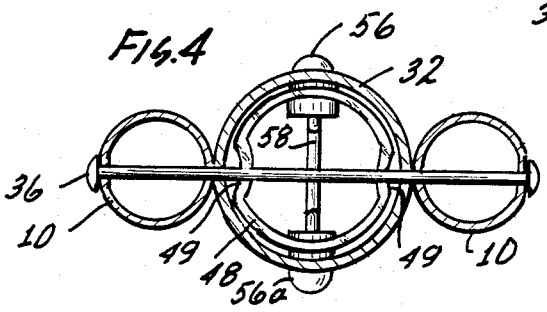

TUBULAR CRUTCH CONSTRUCTION

BACKGROUND OF THE INVENTION

1. Field of the Invention

This invention pertains generally to the field of body support devices for the infirm or handicapped person and more particularly relates to improvements in the construction and assembly of height adjustable tubular crutches.

2. State of the Prior Art

Height adjustable crutches of various designs have been in use for many years. In one particular form, the height adjustment has been accomplished by providing an orificed tubular carrier member secured between parallel lower extremities of two crutch bows. A tubular foot member telescopically carried within the carrier tube has a radially outwardly spring biased detent adapted to project outwardly through any of a series of longitudinally spaced orifices in the carrier tube. By manually pushing the detent inwardly of the carrier tube, the leg member may be slid to a desired degree of extension relative to the carrier tube and secured at that extension by allowing the detent to project radially into the nearest carrier tube oriface.

Various methods of assembling such a crutch, and in particular of securing the lower bow extremities to the carrier tube have been adopted in the past. In one type of adjustable crutch disclosed in this applicant's U.S. Pat. No. 4,509,741, the bows of the crutch are maintained in a normal tubular condition of substantially constant circular cross-section. In particular, the tubular bows retain a normal, undeformed cross-section along the parallel lower extremities between which is supported the carrier tube. The bow members are held to the carrier tube by means of an upper rivet which extends diametrically through the carrier tube and both bow members at a location above the carrier tube orifaces, and also by an end fitting which is encompasses and snugly receives the lower bow ends and the carrier tube so as to hold these three elements in adjacent parallel relationship. The end fitting is riveted to each of the bow ends so as to fix it axially against sliding movement therealong.

While this crutch construction has been found strong and to work well, the lower extremities of the bows terminate in blunt cylindrical ends on each side of the carrier tube. Such blunt cylindrical ends, unless provided with suitably shaped end caps or fittings, define corners which have a tendency to catch on staircase step edges and pose a risk of injury if not used carefully while descending or ascending staircases. This difficulty can be overcome by crushing the lower ends of the bows to a substantially flattened condition and then riveting the crushed bow ends to the carrier tube. The result is a more streamlined crutch construction which tapers smoothly through the transition from the bow ends to lower end of the carrier tube.

This general type of construction, i.e. flattening the bow ends, is already known from a crutch marketed by the Preco Company as their underarm crutch models 6000 and 6050. This prior art crutch is illustrated in FIGS. 1 and 2 of the drawings. As may be seen from these illustrations, the bows in the prior art crutch undergo an abrupt transition from a normal cylindrical tubular state along their upper portions to a fully flattened condition along the full length of their parallel lower extremities laterally adjacent to the carrier tube.

The carrier tube is secured by an upper rivet which passes through the flattened bow portions immediately adjacent the transistion between the normal tubular and flattened portions of the bows and by two lower rivets to each of the flattened bow ends. The bows are also bent at or immediately adjacent to this transition. The strength of this crutch is compromised by the combination of the abrupt transition to a fully flattened state, and by both bending and riveting of the bow tubes immediately adjacent to this transition point.

A continuing need therefore exists for an improved detent adjustable crutch with flattened bow ends but without the aforementioned shortcomings.

SUMMARY OF THE INVENTION

The present invention overcomes these difficulties by providing a detent adjustable tubular crutch having lower bow portions laterally adjacent to the carrier tube. The lower bow portions are progressively crushed in cross section along intermediate, transitional bow sections preferably lying between the upper end and lower ends of the carrier tube. The cross-section of the bows is deformed gradually from the normal cylindrical tubular shape of the upper portions of the bows, through one or more intermediate partially crushed stages, to a substantially fully flattened state along relatively short sections at the lower end of each bow tube. The bow tubes are not bent within either the intermediate or fully crushed portions of the lower extremities so as to maximize the strength of these deformed portions.

The bow members comprise upper mutually parallel spaced apart sections of normal tubular cross-section joined at their upper ends by an underarm cushion or support and are also connected at a lower intermediate location by a handle downwardly spaced from the underarm support. The bow tubes are bent towards each other at a first bend point and then at a second bend point the bows resume a mutually parallel course along their lower extremities, but in more closely spaced relationship, the spacing being substantially the diameter of the carrier tube to be supported between the lower bow extremities. In the prior art crutch of FIGS. 1 and 2 the lower extremities are continuously flattened from the second bend point down to the lower bow ends, and the upper rivet passes through rivet holes below but immediately adjacent this second bend point.

In the improved crutch disclosed herein, the gradual tapering of the lower bow sections from their normal tubular cross-section to the flattened ends occurs between the upper fastener and lower fasteners which secure the lower bow portions to the carrier tube and in particular between the second bend point and the lower ends. The upper fastener rivet therefore extends diametrically through undeformed bow tube portions and through the carrier tube upwardly of the detent orifaces in the latter. The flattened lower ends of the bows are each riveted to the carrier tube to fully secure the crutch assembly. It is preferred to curve and contour the flattened bow ends to the curvature of the carrier tube outer surface so as to achieve the smoothest possible transition between the bow ends and the carrier tube.

BRIEF DESCRIPTION OF THE DRAWINGS

FIG. 1 is an elevational view of a prior art detent height adjustable crutch;

FIG. 2 is a section taken on line 2—2 in the direction of the arrows in FIG. 1;

FIG. 3 is an elevational view of the improved detent height adjustable crutch of this invention.

FIG. 4 is a section taken along line 4—4 in FIG. 3;

FIG. 5 is a section taken along line 5—5 in FIG. 3;

DETAILED DESCRIPTION OF THE PREFERRED EMBODIMENTS

Figure 6:
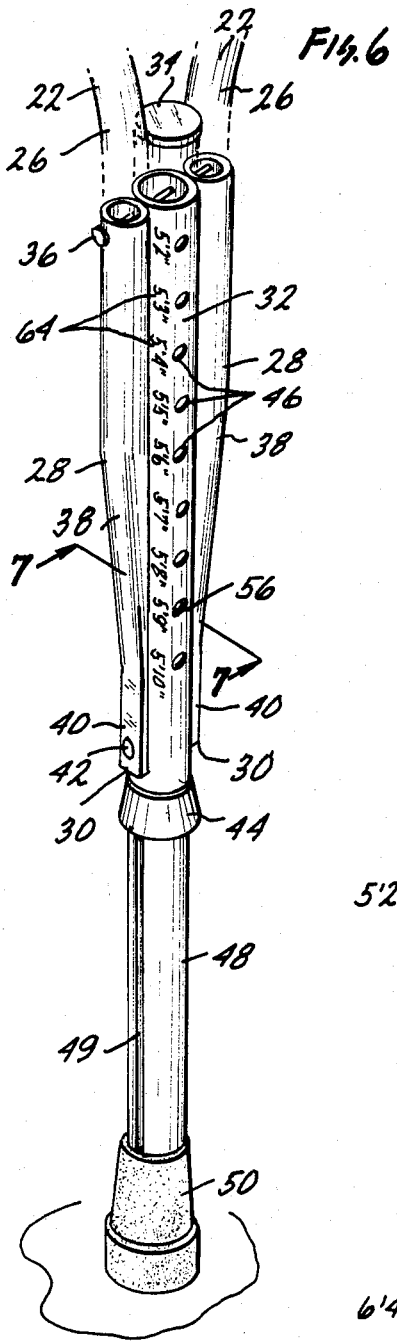
FIG. 6 is an enlarged perspective view of the lower portion of the crutch of FIG. 3.
Figure 9:
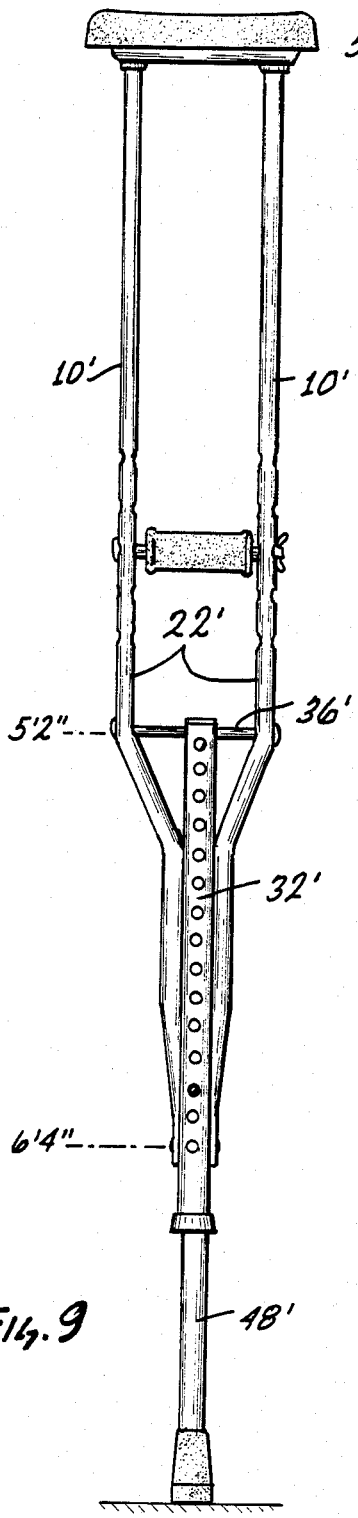
FIG. 9 is an elevational perspective view of a modified embodiment of the invention.

With reference to the drawings, FIGS. 3 and 4 show the crutch bow tubes 10 which are bridged at their upper extremities 12 by an arm support 14 and at their midsections 16 by a hand grip 18. The bows angle inwardly towards each other along sections 22 between a first or upper bend point 24 and a second or lower bend point 26, below which the bow members 10 again resume a mutually parallel but more closely spaced relationship to each other along their lower portions 28, extending downwardly to terminate in lower ends 30. Disposed and secured between the lower bow portions 28 is tubular carrier 32, which is shown secured in the vicinity of its upper end 34 by a bolt or long rivet 36 which extends from a rivet head on the outside of one bow tube 10, diametrically through the bow tube, then diametrically through the carrier tube 32 and finally diametrically through the other bow member 10, terminating in a second rivet head on the outside of the other bow tube to secure it against withdrawal from the crutch elements which it secures together.

The bow members 10 are cylindrical tubes of substantially constant cross-section along their upper portions 12, mid-sections 16, angled sections 22, and through the second bend 26. In particular, the bows retain their normal undeformed tubular cross-section past the upper fastener or rivet 36. Beginning below the upper fastener 36 the bow members are progressively crushed along intermediate, transitional sections 38 from their normal tubular state to a crushed, substantially fully flattened, double walled state along relatively short portions 40 immediately adjacent and terminating at the lower ends 30. The lower ends 30 of the bow members are secured to the carrier tube 32 by means of diametrically opposed lower rivets 42 each of which passes through the flattened double wall thickness of the crushed bow end and through the wall of the carrier tube. The transitional sections 38 thus commence only below the upper fastener 36 so that this fastener passs through openings in cross-sectionally undeformed portions of the crutch bow tubes. Furthermore, the upper fastener 36 is downwardly spaced from the second bend 26 in the crutch bows so as to avoid introducing weakness at that bend because of the necessary openings through which passes the fastener.

In a typical crutch, the fully flattened bow sections 40 may be approximately 2–3 inches in length while the transitional sections 38 may be approximately 4–6 inches in length, it being understood that the exact length is not critical and may be somewhat greater or lesser than the figures given, provided that the fully crushed bow sections 40 are limited to a relatively small end section of each bow tube and that the transitional sections 38 be of sufficient length so as to provide a gradual tapering transition from a cylindrical shape to a fully flattened shape.

The crushing or flattening of the bow tubes in the improved crutch of this invention can be readily accomplished by a punch press operation using a cradle for supporting the lower bow portion 28 to be crushed, and striking the bow with a die which preferably is a piercing die so as to form the rivet hole for the lower rivets 36 in one operation. The cradle and the die are suitably shaped to simultaneously obtain the transitional zone 38 as well as the fully crushed end sections 40.

Figure 7:
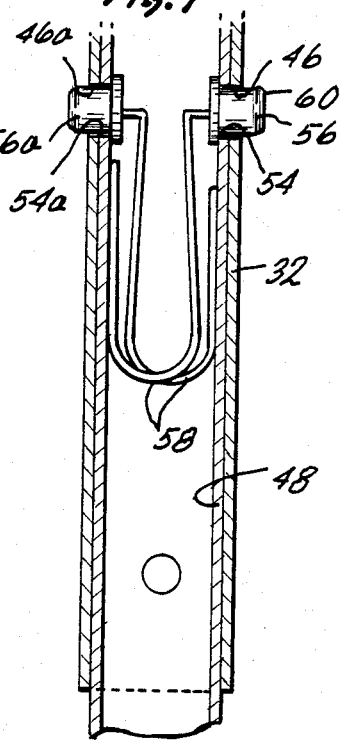
FIG. 7 is a longitudinal section of the carrier tube and foot taken along line 7—7 in FIG. 6.
Figure 8:
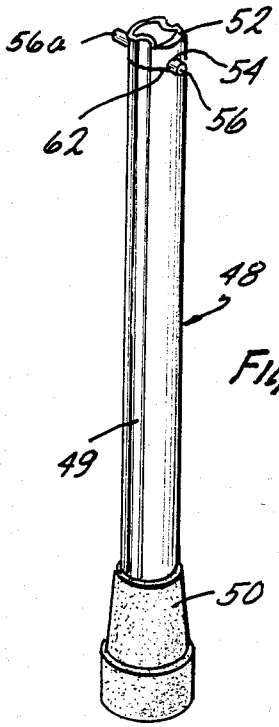
FIG. 8 is a perspective view of the foot member shown withdrawn from the carrier tube.

Telescopically slidable within the carrier 32 is the crutch foot member 48, the lower extremity of which may be provided with a rubber or plastic tip 50, and near the upper extremity 52 of which are provided a pair of diametrically opposed orifaces 54 and **54*a* (FIGS. 7 and 8). A pair of detents 56 and 56*a* are projected through the orifices 54 and $54_a$ respectively and biased radially outwardly through said orifices by spring elements 58**.

As best seen in FIGS. 4 and 5, each rivet 42 at the flattened lower extremities of the bow tubes has an external rivet head as well as an internal rivet head **42*a* within the carrier tube 32. The leg tube 48 is formed with two diametrically opposed longitudinal dimples or grooves 49 so as to accommodate therein the internal rivet heads 42*a***.

When the upper end 52 of the foot member 48 is pushed up into the carrier 32, at any point where the spring biased detents 56 and **56*a* fall into register with any of the pairs of orifices 46, $46_a$ in the carrier 32, the detents will be pushed out through those orifices respectively, thereby locking the foot member against further axial displacement relative to the carrier 32 until the detents are squeezed by a person's fingers radially inwardly to where the rounded tips 60 will slip past the wall of the carrier 32 defining the orifices 46 and $46_a$. Thereupon the foot member 48 may be moved upwardly or downwardly relative to the carrier 32 until the detents 56 and 56*a* fall into register with another pair of orifaces 46, 46*a* respectively in the carrier 32**.

To enable the detents 56 and **56*a* to be brought into register with the desired pair of orifices 46, $46_a$ respectively in the carrier 32, marker lines 62 are desirably provided to extend semi-circularly about each side of the detents 56, 56*a*** as in FIG. 8.

Further, in order to enable the therapist or hospital personnel to set the crutch height properly for the prospective user of the crutch, the carrier 32, desirably, as shown in FIG. 6, is provided with a series of numerals 64, each of which has been empirically calculated with reference to the extension of the foot member 48 from the carrier 32 to indicate the average patient height for the setting of the detents 56, **56*a* and, hence, the extent of the telescopic extension of the foot member 48 relative to the carrier 32. While the numerical height markers have been thus illustrated in certain dispositions, it will be appreciated that they could be placed in other locations as, for example, on the lower portion of the foot member 48 in reference to the carrier stop member 44, or on the bow members 10 in reference to an appropriate indexing element placed on the foot member 48**.

FIG. 8 illustrates a modification of the embodiment of the invention shown in FIG. 3 wherein the carrier member 32' may be extended upwardly between the bow tubes 10' and secured between the more widely spaced sections 22' of the bows and bolted thereto by a longer, partially exposed fastener 36', thereby to accommodate a longer foot member 48' in order to enable the crutch to be employed by taller persons such as basketball players. Otherwise, the embodiment of FIG. 8 may be identical to that of FIGS. 3 and through 6.

From the foregoing description and the accompanying drawings, it may be seen that there is provided a sturdy, but readily height ajustable crutch which obviates the aforementioned shortcomings in the prior art crutch illustrated in FIGS. 1 and 2 of the drawings. Thus, in the present invention, the strength of the undeformed tubular bow members 10 is preserved while the carrier is secured between them most effectively by upper and lower fasteners 36 and 42 respectively while achieving a tapered, streamlined, safer configuration.

What is claimed is:

1. In a crutch of the type having a pair of tubular bow members, said bow members having upper ends connected by an underarm support, said bow members having spaced apart upper portions, angled sections between two bend points and parallel lower portions each terminating in a lower end, a carrier tube supported between said lower portions by fastener means spaced along said carrier tube, a crutch leg telescopable within said carrier tube, and means for releasably locking said leg to said carrier tube at a selected relative extension therefrom, the improvement wherein said lower portions are progressively crushed along said lower portions between said upper and lower carrier tube ends from a cylindrical tubular shape through one or more intermediate partially crushed sections to a substantially fully flattened double walled state, said fastener means including upper fastener means securing said carrier tube to each of said bow members at a location significantly upwardly of both said partially crushed and fully flattened sections, and lower fastener means securing said carrier tube to each of said fully crushed lower ends;

said lower fastener means consisting of two lower rivets, each rivet passing through both said walls of one of said crushed lower end and the wall of said carrier tube, said lower rivets each having a substantially flat rounded rivet head external to said fully crushed lower ends such that the lower portions of the bows are substantially protected against catching on staircase edges and the like.

2. The crutch of claim 1 wherein each said lower rivet has a rivet head internal to said carrier tube and said crutch leg is longitudinally dimpled to accommodate each said internal rivet head while making a snug sliding fit with said carrier tube.

3. The crutch of claim 1 wherein said carrier tube is cylindrical and said flattened ends are contoured to lie against the cylindrical outer surface of said carrier tube.

4. The crutch of claim 1 wherein said upper fastener means is a single long rivet passing diametrically through both said bow members and said carrier tube.

5. The crutch of claim 1 wherein said lower portions are immediately adjacent and parallel to said carrier tube along both said intermediate and fully crushed sections.

6. The crutch of claim 5 wherein said bow members are immediately adjacent said carrier tube also in the region of said upper fastener means, said upper fastener means passing through openings in said bow membrs formed below both of said bend points.

7. In a crutch of the type having a pair of cylindrical tubular bow members having upper ends connected by an underarm support and each having a lower portions terminating in a lower end, a cylindrical carrier tube supported between said lower portions, a crutch leg telescopable within said carrier tube, and means releasably locking said leg to said carrier tube at a selected relative extension thereform, the improvement wherein said lower portions are progressively crushed from an undeformed normal tubular state through a transitional segment of partially crushed cross-section tapering to a substantially fully flattened double-walled state at said lower ends, said carrier tube being secured to each of said bow members by an upper rivet passing diametrically through said bow members through undeformed portions of said bow members, each of said flattened lower ends being secured to said carrier tube by at least one lower rivet passing through both said walls and the wall of said carrier tube, each said lower rivet having a rivet head internal to said carrier tube and said crutch leg being longitudinally dimpled to accommodate each said internal rivet head while making a snug sliding fit with said carrier tube, each said lower rivet further having a substantially flat rounded rivet head external to said fully crushed lower ends such that the lower portions of the bows are substantially protected against catching on staircase edges and the like.

* * * * *